United States Patent [19]

Human

[11] Patent Number: 4,483,157

[45] Date of Patent: Nov. 20, 1984

[54] COLD PACK FOR BEVERAGE KEG

[76] Inventor: Robert J. Human, 1808 S. Hanley Rd., St. Louis, Mo. 63144

[21] Appl. No.: 564,840

[22] Filed: Dec. 23, 1983

[51] Int. Cl.[3] ..... B67D 5/62

[52] U.S. Cl. ..... 62/400; 62/457

[58] Field of Search ..... 62/400, 457, 371, 372, 62/529, 530, 458

[56] References Cited

U.S. PATENT DOCUMENTS

| | | | |
|---|---|---|---|
| 3,338,068 | 8/1967 | Piker | 62/457 X |
| 3,443,397 | 5/1969 | Donovan et al. | 62/457 X |
| 3,614,875 | 10/1971 | McCallum | 62/457 X |
| 4,071,160 | 1/1978 | Vick | 62/400 |
| 4,242,884 | 1/1981 | Kotschwar | 62/371 |

*Primary Examiner*—Lloyd L. King

*Attorney, Agent, or Firm*—Rogers, Eilers & Howell

[57] ABSTRACT

This invention relates to a cold pack for keeping beverage kegs cold during shipment, storage, and use. The cold pack comprises a container for the keg of rigid insulating material closely conforming to the keg and a tight fitting lid. The lid has a removable central panel to allow access to the keg valve. Upper and lower refrigerant cases are sized and shaped to fit the top and bottom of the keg, respectively, contacting the keg over a substantial area to facilitate conduction of heat from the keg. The upper case has a central hole designed to receive and surround the keg valve.

20 Claims, 4 Drawing Figures

COLD PACK FOR BEVERAGE KEG

BACKGROUND AND SUMMARY

This invention relates to cold shipping and storage containers and specifically to a cold pack for keeping beverage kegs cold during transportation, storage, and use.

Beverage kegs are typically chilled in ice baths in wash tubs, trash barrels, or the like. Such tubs or barrels are generally not provided by the beverage suppliers because of the expense and storage problems, and to the cusumer they are relatively expensive, especially in light of the occasional use they receive. The tubs or trash barrels are also unsightly at parties and other social functions and occupy a lot of space.

The key in the ice bath is very unwieldly and difficult to transport. The tub or barrel and the ice bath add significantly to the weight of the already heavy keg. The tub or barrel also add significantly to the size and bulk of the keg, a problem that is compounded by the fact that the tub or barrel usually must be kept upright. There is also the problem of leakage or spillage of the melting ice and of condensation of the exterior of the tub or barrel, and the ice must be continuously replenished as it melts. Even after the keg is emptied, the tub or barrel must be transported and stored.

To minimize many of these difficulties, the kegs are often transported separately and chilled at the location of consumption. However, the contents may be adversely affected by such temperature variations. Some beverages such as beer may spoil or become contaminated if not maintained at the proper temperature. Furthermore, the contents may not reach the desired temperature before consumption. Finally, the problems of dealing with the tub or barrel, and the leakage or spillage of melting ice are only postponed, not eliminated.

The kegs are subject to a lot of abuse, even normal wear and tear in transporting and using the kegs takes a heavy toll, limiting their useful life.

One attempt to alleviate some of the problems of dealing with beverage kegs is shown in McCallun, U.S. Pat. No. 3,614,875, which discloses a flexible bag that can hold a beverage keg, the bag having a plurality of side pockets for holding ice against the keg. This device does not solve many of the difficulties just discussed. Because of the thin walls required to make the bag flexible and permit heat transfer between the keg and the pockets of refrigerant, a large quantity of refrigerant would be needed to offset the influx of heat through the bag. This would increase the expense and add to the weight of the bag. At the several points where the keg was separated from the atmosphere by just the bag, heat could be conducted directly to the keg. The thin bag walls could also leak refrigerant and would permit condensation on the exterior surface of the bag. Furthermore, any movement of the keg or bag would cause the bag to act as a bellows, blowing out the cold interior air and sucking in warm ambient air.

The applicant has invented a cold pack for keeping beverage kegs cold during transportation, storage, and use, one that solves the many problems of the prior art. The cold pack comprises an inexpensive, lightweight, stiff walled insulating container for the keg having a tightfitting lid. The stiff walls prevent the bellows action encountered with flexible containers. The insulating walls minimize heat transfer from the atmosphere. The container is shaped to closely conform to the shape of the keg. This establishes a thin shell of air surrounding the keg, which enhances the insulating capability of the container because of air's low heat transfer capacity. The container also closely conforms to the keg to eliminate large air pockets, like those that would be found in the corners of square boxes, to prevent the formation of cells of convective air currents that would transfer heat from the container walls to the keg. The container is preferrably sized so that the walls do not contact the keg to prevent direct conduction of heat from the container to the keg.

The container has an inexpensive, light-weight, stiff, insulating lid with downwardly depending sides that effect a tight fit with the container. The lid and container interfit such that there is a thin shell of air between the lid and the keg to minimize convective and conductive heat transfer. The center of the lid is provided with a removable center panel aligned with the value in the keg. Removal of the panel allows access to the valve so that a spigot can be attached to dispense the contents of the keg. The size of the removable center panel is as small as possible to minimize the influx of heat when it is removed.

Because of the double insulation of the keg provided by the insulating container and the air shell, heat transfer to the keg is minimized so much less refrigerant is required than in the prior art methods. This not only reduces the cost, but makes the cold pack lighter and very easy to transport. Cooling is provided by two cases of refrigerant. The refrigerant can be ice, but is preferably one of the refrigerant gels, well known in the art, that in the desired temperature range for the keg has a high capacity for heat absorption with minimal temperature change. One case is placed on the top of the keg and one case is placed on the bottom of the keg. The upper case is donut shaped, with the central aperture sized to receive and surround the valve in the top of the keg. The bottom of the upper case conforms to the top surface of the keg, contacting a substantial portion of the surface so that heat is readily conducted from the keg to the case. The lower case, for simplicity, can be like the upper top case so that a stock of different cases is not required. The top of the lower case conforms to the bottom surface of the keg, contacting a substantial portion of the surface so that heat is readily conducted from the keg to the case.

Hand holes are provided on opposing sides of the container, near the top in a position so that the handles on the keg can be aligned therewith. The lid has hand holes aligned with those in the container. The cold pack can be easily carried by gripping the keg directly through the hand holes in the container and lid.

The cold pack of this invention provides a compact, inexpensive and convenient way to store, transport, and dispense beverages from a keg. The container and lid are lightweight and compact and do not impede the transportability of the keg. The keg handles are readily accessible. The container and lid insulate the keg eliminating condensation on the exterior, and reducing the amount of coolant required, thereby lowering costs and reducing weight. The container and lid also completely enclose the keg, protecting the keg from wear and tear and abuse, and making it more presentable. The container and lid can even be decorated, if desired, or advertisements can be put on the container and lid. The packaged refrigerant will not leak, and if refrigerant gel is used, it will provide more cooling for the weight. The cold pack keeps the keg cold for extended periods of time, which is important since suppliers are often long distances from the point of consumption. The cold pack is so compact and convenient it can be used anywhere and it makes kegs so easy to handle that it will reduce the number of nonreusable bottles and cans used, to obvious environmental advantage. These and other advantages will be more apparent after reference to the drawings and the description of the preferred embodiment.

DETAILED DESCRIPTION OF THE PREFERRED EMBODIMENT

Figures 1, 2:
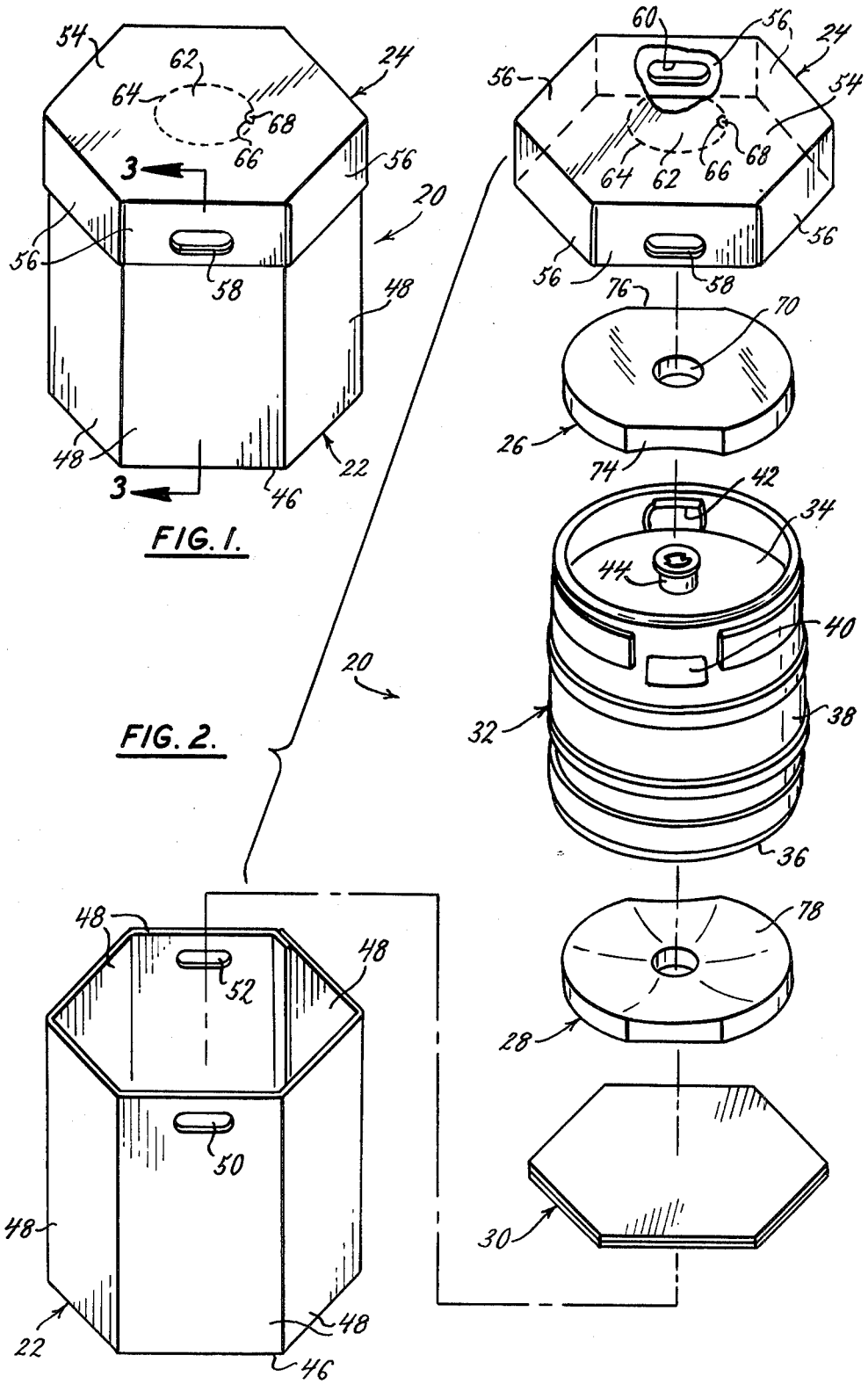
FIG. 1 is an orthogonal view of a beverage keg cold pack constructed according to the principles of this invention.
FIG. 2 is an exploded orthogonal view of the components of the cold pack, with a section removed from the lid, and showing the beverage keg.
Figure 4:
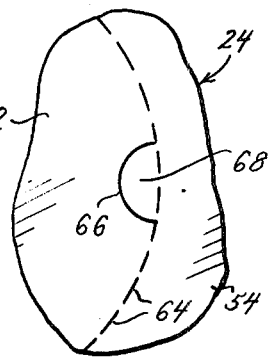
FIG. 4 is a partial view of the lid of the cold pack, showing the removable center panel.

A beverage keg cold pack, constructed according to the principles of this invention, is indicated generally as 20 in FIG. 1. As shown in FIG. 2, cold pack 20 comprises container 22, lid 24, upper refrigerant case 26, and lower refrigerant case 28, and bottom liner 30.

The cold pack 20 is designed to chill and keep a beverage keg 32 cold during transportation, storage, and use. Keg 32 has a top 34, a bottom 36, and a generally cylindrical sidewall 38. Two handles, 40 and 42, are integrally formed in sidewall 38 of keg 32 near the top edge and directly opposite each other. A valve 44 protrudes from the center of top 34 of keg 32.

Container 22 comprises bottom 46 and six sides 48 in regular hexagonal configuration. Container 22 is made from an inexpensive, lightweight, stiff, insulating material, such as corrugated cardboard. Container 22 is sized to closely conform to the side walls 38 of keg 32 to define a thin shell of air around keg 32 for added insulation, and to eliminate large pockets of air in which cells of convective air currents might form and increase the heat transfer to the keg. It is preferable that sidewall 38 of keg 32 not contact sides 48 of container 22, to prevent direct conduction of heat to keg 32. Two hand holes 50 and 52 are formed in opposing sides 48 of container 22 near the top edge in position so that handles 40 and 42 of keg 32 can be aligned therewith.

Lid 24 comprises top 54 and six downwardly depending sides 56 in the same configuration as sides 48 of container 22. Lid 24 is made from an inexpensive, lightweight, stiff, insulating material, such as a corrugated cardboard. Lid 24 fits tightly over container 22, sides 56 of lid 24 overlapping sides 48 of container 22. Two hand holes, 58 and 60, are formed in opposing sides 56 of lid 24, near the bottom edge, in position so that when lid 24 is properly installed on container 22, hand holes 58 and 60 and lid 24 are aligned with hand holes 50 and 52 in container 24. In the center of top 54 of lid 24 is a circular removable panel 62 defined by a circular perimeter of perforations 64. A semi-circular cut 66 adjacent perforations 64 defines a semi-circular tab 68 which can be pushed in to create a finger hole to assist in the removal of panel 62. Panel 62 is sized and positioned so that when removed, sufficient access to valve 44 on the top 34 of keg 32 is available for the installation of a spigot for dispensing the contents of keg 32. The size of panel 62, and thus the hole, is minimized to minimize the influx of heat when the panel is removed.

The upper refrigerant case 26 is doughnut shaped. Upper case 26 can, for example, be made from plastic. Its central aperture 70 is sized to receive and surround valve 44 on top 34 of keg 32. The bottom 72 of upper case 26 conforms to top 34 of keg 32, contacting top 34 over a substantial portion of its surface, thereby providing a large surface for heat conduction from keg 32 to upper case 26. Upper case 26 is filled with a refrigerant. Any one of the refrigerant gels well known in the art can be used. The gel should be one that can absorb a substantial amount of heat with minimal temperature change, in the desired range of temperature for keg 32. Before use, the case can be chilled in a freezer. The perimeter of upper case 26 has two flattened regions 74 and 76, opposite each other, that can be aligned on the top 34 of keg 32 with handles 40 and 42, to avoid interference with the proper gripping of handles 40 and 42.

lower refrigerant case 28 can be identical to upper refrigerant case 26 to eliminate the need for making and stocking separate types of cases. Again, it is desirable that the upper surface 78 of lower case 28 conform to bottom 36 of keg 32, contacting bottom 36 over a substantial portion of its surface, thereby providing a large surface of heat conduction from the keg 32 to lower case 28.

Figure 3:
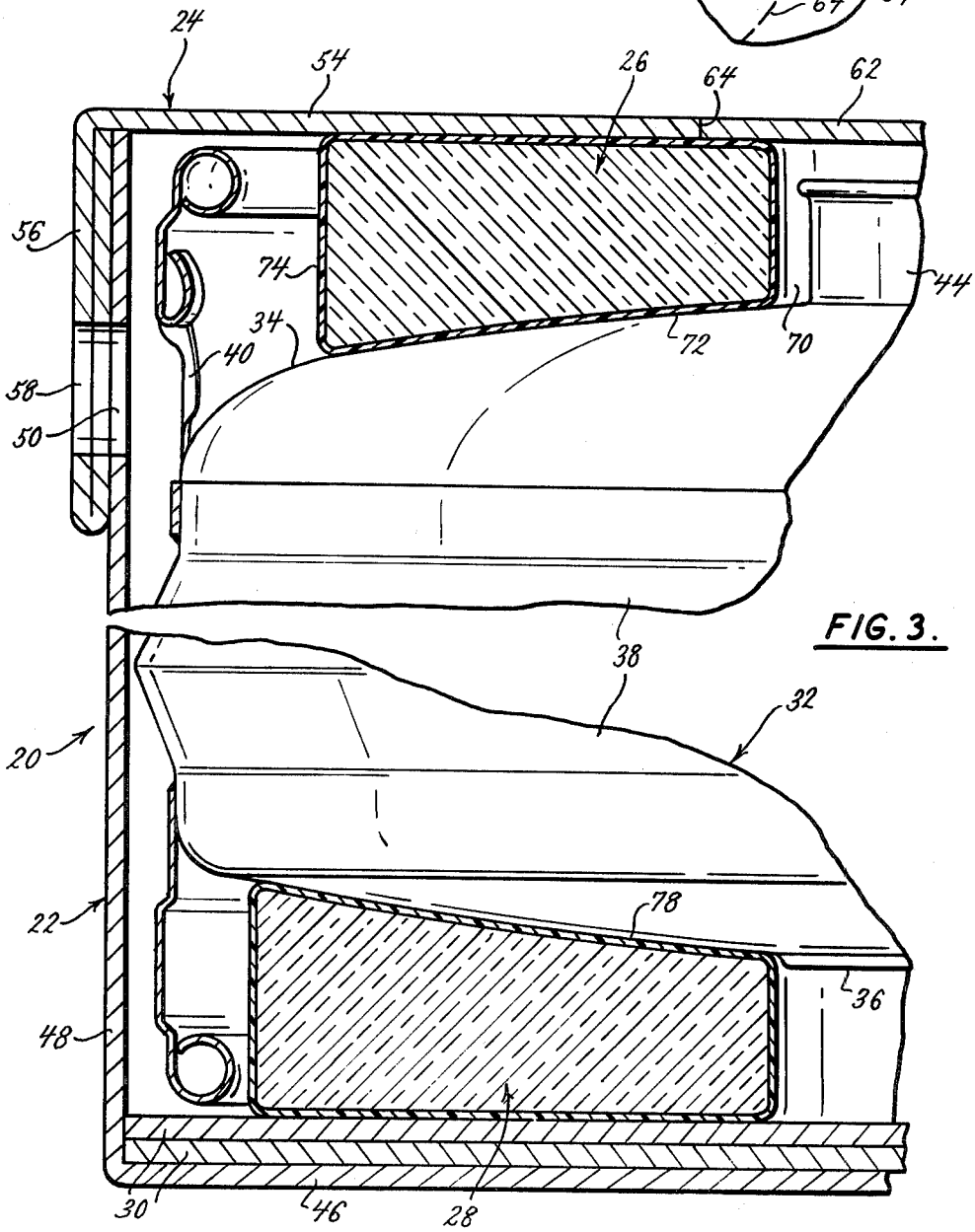
FIG. 3 is a partial, sectional view of the cold pack taken along line 3—3 in FIG. 1.

As illustrated in FIGS. 2 and 3, the keg 32 is installed in cold pack 20 by first inserting bottom liner 30 into the container. Bottom liner 30 is hexagonally shaped and is preferably an inexpensive lightweight absorbent insulating material, such as corrugated cardboard. The liner 30 is added insulation to prevent conduction of heat through the bottom 46 of container 22. Liner 30 also serves to absorb moisture that might weaken the bottom 46 of container 22. Lower refrigerant case 28 is placed on top of liner 30. Keg 32 is inserted into container 22, with handles 40 and 42 aligned in the hand holes 50 and 52 in container 22. Upper refrigerant case 26 is placed on top 24 of keg 32 around valve 44, with flattened regions 74 and 76 aligned in the handles 40 and 42 of keg 32. Finally, lid 24 is placed over container 22, so that hand holes 48 and 60 in lid 24 are aligned with hand holes 50 and 52 in container 24.

Once properly installed in the container, keg 32 is insulated from the conduction or convection of heat from the atmosphere. In addition, upper and lower refrigerant case 26 and 28 conduct heat from keg 32 over their substantial contact surface with keg 32. The entire cold pack 20 is not much larger than keg 32 itself, and can be easily transported by gripping handles 40 and 42 on keg 32 which are accessible through aligned hand holes 58 and 60, and 50 and 52.

Although the container 22 and lid 24 are made from an inexpensive material, such as corregated cardboard, they are reusable, and it is easy to return the keg still in the cold pack to the supplier. Thus, the cold pack is a convenient way for the supplier to provide kegs to his patrons. The cold pack 20 is also inexpensive and useful enough for the customers to supply themselves.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A cold pack for keeping a beverage keg cold during transportation, storage, and use, the keg having a top, a bottom, and sidewalls therebetween and further comprising a valve in the center of the top of the keg, said cold pack comprising:

a container for the keg, of rigid insulating material, having a bottom and sidewalls, the sidewalls closely conforming to the keg to form a thin shell of air between a keg and the container;

a lid for the container, of rigid insulating material, having downwardly depending sides in the same configuration as the container sidewalls, and interfitting therewith in close mating relationship;

an upper case, having a central hole and filled with a refrigerant substance, on the top of the keg, the upper case sized and shaped to fit on top of the keg, with the keg valve protruding through the central hole in the upper case, and to contact a substantial portion of the top of the keg.

2. The cold pack of claim 1 further comprising a lower case, filled with a refrigerant substance, on the bottom of the keg, and sized and shaped to fit the bottom of the keg to contact a substantial portion of the bottom of the keg.

3. The cold pack of claim 1 wherein the lid further includes a removable central panel to allow access to the valve in the top of the keg.

4. The cold pack of claim 1 wherein the container is sized so that the side walls of the container do not contact the keg.

5. The cold pack of claim 1 wherein the container and the lid have a plurality of sides in regular polygonal configuration.

6. The cold pack of claim 5 wherein the container and the lid have at least five sides.

7. The cold pack of claim 1 wherein the container and lid are made from corrugated cardboard.

8. A cold pack for keeping a beverage keg cold during transportation, storage, and use, the keg having a top, a bottom, and sidewalls therebetween, and further comprising a valve in the center of the top of the keg, said cold pack comprising;

a container for the keg, of rigid insulating material, having a bottom and sidewalls, the sidewalls closely conforming to the keg to form a thin shell of air between the keg and the container;

a lid for the container, of rigid insulating material, having downwardly depending sides in the same configuration as the container, and interfitting therewith in close mating relationship, the lid further including a removable central panel to allow access to the valve in the top of the keg;

an upper case, having a central hole and filled with a refrigerant substance, on the top of the keg, the upper case sized and shaped to fit on top of the keg, with the keg valve protruding through the central hole in the upper case, and to contact a substantial portion of the top of the keg to permit conduction of heat from the keg; and, a lower case filled with a refrigerant substance on the bottom of the keg, the lower case sized and shaped to fit on the bottom of the keg and to contact a substantial portion of the bottom of the keg to permit conduction of heat from the keg.

9. The device of claim 8 wherein the container and lid are made from corrugated cardboard.

10. The device of claim 8 wherein the removable central panel in the lid is formed by a circle of perforations in the lid.

11. The cold pack of claim 8 wherein the container and lid have a plurality of sides in a regular polygonal configuration.

12. The cold pack of claim 8 wherein the container is sized so that the sides of the container do not contact the keg.

13. The cold pack of claim 8 wherein the keg further comprises a pair of handles on opposing sides of the keg near the upper edge, and wherein the container further comprises means for defining hand holes on opposite sides of the container and positioned so that the keg handles can be aligned therewith.

14. The device of claim 13 wherein the lid further comprises means for defining hand holes, positioned to be aligned with the means for defining hand holes in the container.

15. A cold pack for keeping a beverage keg cold during transportation, storage, and use, the keg having a top, a bottom, and sidewalls therebetween, and further comprising a pair of handles on opposing sides of the keg near the upper edge, and a valve in the center of the top of the keg, said cold pack comprising:

a container for the keg, of rigid insulating material, having a bottom and a plurality of sides in regular polygonal configuration, the sidewalls closely conforming to the keg to form a thin shell of air between the keg and the container, the container further comprising means for defining hand holes on opposing sides of the container in position so that the keg handles can be aligned therewith;

a lid for the container, of rigid insulating material, having downwardly depending sides in the same configuration as the container, and interfitting therewith in close mating relationship, the lid including means for defining hand holes, aligned with the means for defining hand holes in the container, the lid further including a removable central panel to allow access to the valve from the top of the keg;

an upper case, having a central hole and filled with a refrigerant substance, on the top of the keg, the upper case sized and shaped to fit on top of the keg, with the keg valve protruding through the central hole in the upper case, and to contact a substantial portion of the keg to permit conduction of heat from the keg;

a lower case, filled with a refrigerant substance, the lower case sized and shaped to fit on the bottom of the keg to contact a substantial portion of the bottom of the keg to permit conduction of heat from the keg.

16. The cold pack of claim 15 wherein the upper case has opposing flattened regions in its perimeter alignable with the keg handles so that the upper case does not hinder use of the keg handles.

17. The cold pack of claim 15 wherein the container and lid are made from corrugated cardboard.

18. The device of claim 15 wherein the removable central panel in the lid is formed by a circle of perforations in the lid.

19. The cold pack of claim 15 wherein the container is sized so that the sides of the container do not contact the keg.

20. The cold pack of claim 15 wherein the container and lid have six sides.

* * * * *